US006758367B2

(12) United States Patent
Hunts

(10) Patent No.: US 6,758,367 B2
(45) Date of Patent: Jul. 6, 2004

(54) CUSHION PRESSING MEMBER FOR BLISTER PACK OPENING AND DISPENSING TOOLS

(76) Inventor: Larry D. Hunts, 1111 Netherlands Rd., Trail, OR (US) 97541

( * ) Notice: Subject to any disclaimer, the term of this patent is extended or adjusted under 35 U.S.C. 154(b) by 170 days.

(21) Appl. No.: 10/209,055

(22) Filed: Jul. 31, 2002

(65) Prior Publication Data

US 2003/0029880 A1 Feb. 13, 2003

Related U.S. Application Data

(60) Provisional application No. 60/311,022, filed on Aug. 8, 2001.

(51) Int. Cl.[7] ..... B65B 69/00
(52) U.S. Cl. ..... 221/25; 414/412
(58) Field of Search ..... 221/25, 30, 31, 221/131; 414/412; 30/363, 364; 294/118, 16

(56) References Cited

U.S. PATENT DOCUMENTS 5,472,115 A 12/1995 Whiton
5,722,563 A * 3/1998 Hunts ..... 221/25
6,098,835 A * 8/2000 DeJonge ..... 221/25
6,155,454 A * 12/2000 George et al. ..... 221/25
6,206,233 B1 * 3/2001 Schulze ..... 221/25

FOREIGN PATENT DOCUMENTS

EP 0 305 895 A1 8/1988

* cited by examiner

*Primary Examiner*—David H. Bollinger
(74) *Attorney, Agent, or Firm*—Olson & Olson

(57) ABSTRACT

A resilient cushion pressing member is provided on the movable pressing structure of a tool for removing tablets from blister packages for pressing engagement of the resilient cushion pressing member against the top, blister surface of a tablet-containing blister package supported on a package support base of the tool, the cushion pressing member formed of an elastomeric material selected to resiliently deform under pressing engagement to distribute pressing force substantially evenly over the engaged surface of a blister package and a tablet contained therein to prevent breakage of the tablet as it is pressed to tear through and exit the bottom, tear sheet of its packaging.

11 Claims, 3 Drawing Sheets

CUSHION PRESSING MEMBER FOR BLISTER PACK OPENING AND DISPENSING TOOLS

This application claims benefit under 35 U.S.C. 119(e) of earlier filed U.S. Provisional application Serial No. 60/311,022, filed Aug. 8, 2001.

BACKGROUND OF THE INVENTION

This invention relates to tools for removing tablets from blister packages, and more particularly to a resilient cushion pressing member for the movable pressing structure of such tools to provide a resilient cushioning surface interengagement between the pressing structure of the tool and a blister package supported on a package support base of the tool during pressing operation of the tool.

There are a great many different types and arrangements of such tools for this purpose, and examples of merely a few of such blister package-opening tools are seen in U.S. Pat. Nos. 5,472,115 and 5,722,563 having common ownership with this invention and incorporated herein by reference, and European Patent EP 0305895A1. The first two patents illustrate a pliers-type hand tool construction which utilizes a movable pressing structure having a pivoting jaw member mounting a hard, rigid impact/pressing member which travels in an arcuate path toward a blister package supported on a package support base of the tool to engage and press tablets from blister packages, while the third patent shows a ram-type tool construction utilizing an impact plunger member arranged for travel along an axial path to press tablets from blister packages. The present invention is entirely workable with both arcuately moving and axially moving pressing structures of all forms of such tools.

As is known by those skilled in the art as well as by those who have used these tools of the prior art, there is an inherent problem in the mechanical pressing of tablets and capsules from blister packages through a package supporting tool base member by a moving pressing member. The problem is that while these tools operate well to press upon some tablets and force them to tear through and exit the bottom of their blister packages, many other tablets simply break, split or are substantially pulverized during the pressing process of the tool. Almost invariably gel tabs break when these tools are used. This problem is the consequence of the tremendous variety of different tablet sizes, shapes, consistencies, and hardnesses that must be accommodated, as well as the various different packaging characteristics involved in the wide array of product packages that these tools are used for. The accepted fact of these tools of virtually every type of construction provided heretofore is that they simply are not successfully usable with a great number of types of tablets and capsules which inevitably break or are crushed by the pressing structure of the tools.

In this regard, tablets having a soft or frangible consistency can easily break or be crushed under the force of the hard pressing member of the tool whereas hard, dense tablets are less likely to break. Understandably, gel-type and liquid-filled capsules often burst whereas hard caplets and the like clearly will not. Also, different blister packages have different tear characteristics depending on the materials employed for their bottom cover sheet. Some packages tear very easily as the tablet is pressed against the cover sheet while other packagings resist tearing rather strenuously and therefore require additional pressing force be applied against the tablet by the pressing member of the tool. This obviously increases the likelihood of breaking and crushing of tablets and pills.

In the development of these tools various efforts have been made to facilitate the tearing of the bottom of the package during operation of the tool. These have included cutting elements positioned on the hard pressing members of tools configured to puncture through the bottom of the blister package during pressing operation of the tool, and configuring the openings through the package supporting base in a manner so as to provide a shearing effect on the bottom cover of the package as the tablet is pressed therethrough, also serving to facilitate the cutting of the package open. However, these modifications often don't accommodate tablets and pills of different shapes and sizes and orientations within their blister packaging and still do not overcome the inherent breaking problems associated with the use of hard, rigid pressing members as has been the only practice in the prior art tools.

After extensive trial and error experimentation and development it has been discovered that the foregoing problems in the use of mechanical pressing tools for blister packaged tablets, capsules and pills are substantially entirely eliminated by the provision of the resilient cushion pressing member of this invention, which allows virtually all types of pressing tools for blister packs to successfully remove substantially all types and forms of tablets, etc. from blister packs undamaged.

SUMMARY OF THE INVENTION

In its basic concept this invention provides a resilient cushion pressing member for the movable pressing structure of blister package opening tools for pressing engagement of a blister package by the resilient cushion pressing member whereby to resiliently cushion and distribute pressing force substantially evenly over the contacted surface of the package and the tablet contained therein throughout the pressing process of the tool.

It is by virtue of the foregoing basic concept that the principal objective of this invention is achieved; namely, the provision of a cushion pressing member for blister package opening tools that substantially reduces tablet breakage during operation of the tool and also substantially increases the range, type and number of different tablet and blister package combinations that can be successfully served by the package opening tool, thereby overcoming the disadvantages and limitations of blister package opening pressing tools of the prior art.

Another object and advantage of this invention is the provision of a cushion pressing member of the class described which may be mounted on the movable pressing structure of a blister package opening tool by any suitable mounting arrangement as may be desired or required during manufacture of the tool.

Another object and advantage of this invention is the provision of a cushion pressing member of the class described which may be provided as a separate, independent pressing element configured for mounting on the movable pressing structure of a tool in any suitable manner after manufacture of the tool in replacement of the pressing member provided on the tool during manufacture for upgrade of the tool.

Another object and advantage of this invention is the provision of a cushion pressing member of the class described which is formed of an elastomeric material having predetermined resiliency characteristics selected to engage a blister package and a tablet contained therein deformably in order to more evenly distribute pressing force over the entire contacted surface area of the resilient pressing member.

A further object and advantage of this invention is the provision of a cushion pressing member of the class described which may be used on blister package opening tools having either arcuately-moving or axially-moving pressing structures.

A still further object and advantage of this invention is the provision of a cushion pressing member of the class described which is of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
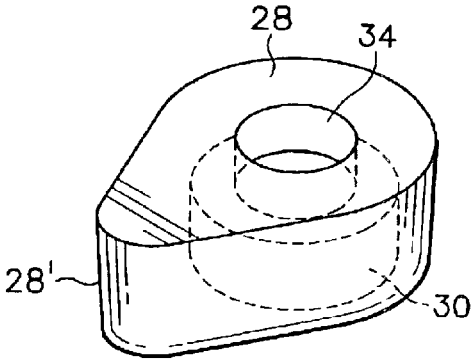
FIG. 1 is a perspective view of a first embodiment of a resilient cushion pressing member embodying features of this invention.

As used herein, the term "tablet" is to be understood to refer to and include any and all shapes, types, forms and configurations of pharmaceutical tablets, pills, capsules, caplets, gel tabs, liquid-filled capsules, etc. packaged in blister packaging.

Referring to the various types of hand tools that have been provided heretofore, they basically fall into two general categories: Those that utilize a movable pressing structure that is configured for movement along a substantially arcuate path toward a corresponding package support base structure, as for example the pivoted, pliers-type hand tool shown in FIG. 2, and those tools that utilize a movable pressing structure configured for movement along an axial path toward the package support structure, as shown in the ram-type tool of FIG. 5. With regard to the pivotal tool construction 10 of FIG. 2, a pair of opposite arm members 12, 14 are connected pivotally together by a pivot member 16 which, in the pliers-type arrangement shown, divides the arm members into handle end members 12*a*, 14*a* and corresponding, opposite, working end jaw members 12*b*, 14*b*. As is understood by those skilled in the art, the lower jaw member 12*b* forms a blister package support base member 18 having an opening 20 therethrough configured for free passage of a tablet pressed from the packaging as is known in the art and clearly explained in detail in the aforementioned patents incorporated herein.

The other, upper jaw member 14*b* forms the movable pressing structure of these tools and is configured with a blister package-engaging pressing surface 22 formed of hard, rigid material such as metal, plastic, hard rubber or other non-resilient material heretofore considered correct for the adequate crushing of the plastic top cover 24 of a blister pack and subsequent tearing of the bottom cover layer 26 by the tablet T being pressed therethrough. It had long been believed that the pressing surface merely had to function to engage and press against and effectively crush the top cover and force the tablet downward to and through the opening 20 in the package-supporting base of the tool. It had also long become recognized and accepted in the art that many various different tablets, pills, capsules and blister packages simply were not workable with these mechanical removing tools.

In the production of the tools of the aforementioned commonly owned patents, numerous structural changes have been attempted in order to improve the tools' capability to properly remove all of the various types and forms of blister packaged pharmaceutical products encountered in the marketplace. However, none of the various structural changes to the tools' basic construction resulted in any significant increase in the tools' ability to function successfully with both hard and particularly soft or brittle tablets, much less liquid-filled capsules and gel caps, etc. It thus became evident that a solution to the limitations of the tools' operation needed to focus on modifying the forces and stresses being applied directly on the blister pack and tablet by the pressing elements of the tool, and ultimately the resilient cushion member of this invention was discovered and painstakingly refined, and will now be described in detail.

A resilient cushion pressing member 28 such as that embodied in FIG. 1 of the drawings is formed of elastomeric material such as rubber, vinyl, synthetic thermoplastic resins and others, to provide a unitary resilient block having a durometer in the general range of between approximately 60–90. This durometer range defines a range of resiliency which has been found to be suitable for operation of the cushion pressing member of this invention. Outside of this range a cushion pressing member is either too resilient or too soft for proper function, or otherwise is insufficiently resilient or too hard, to provide proper function.

It has been determined that if the cushion pressing member is too soft or too pliant, it deforms too much when pressed against the blister package and does not impart proper pressing action thereagainst, and therefore is ineffective for the purpose. Conversely, if the cushion pressing member is formed of too hard an elastomeric material, it has insufficient resiliency to deform enough when pressed against a blister package and therefore is substantially no different than the hard, rigid pressing elements provided in the prior art tools. One preferred cushion pressing member is formed of rubber having a mean hardness of approximately 67.2.

Figure 1A:
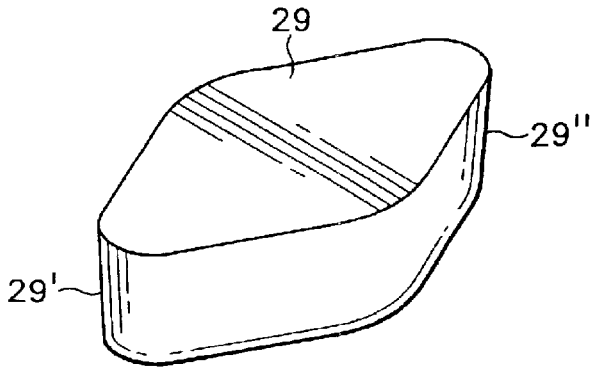
FIG. 1A is a perspective view of a second embodiment of a resilient cushion pressing member embodying features of this invention.

Although the resilient cushion pressing member of this invention may be provided with many different overall surface configurations, one preferred form is illustrated in FIG. 1 wherein the resilient cushion pressing member 28 is provided as a block of elastomeric material, generally circular in cross section with, as illustrated, a forwardly elongated, blunted nose portion 28'. Alternatively, a resilient pressing member 29 may also be formed with both forwardly and rearwardly elongated blunted nose portions 29', 29" extending in opposite directions from the enlarged center section, as shown in FIG. 1A. In the embodiment illustrated in FIG. 1, the block is approximately 0.5 inch laterally across the diameter of the circular portion and approximately 0.65 inch longitudinally through its elongated dimension, and approximately 0.2 inch thick. It is to be understood however that while these dimensions do indicate general scale in one preferred form of the invention, the resilient cushion pressing member of this invention is not limited to particular dimensions.

For reasons which will become clear later, the enlarged circular portion of the pressing member 28 may include a recessed opening 30 extending inwardly into the interior of the block and terminating at a point a spaced distance inwardly from the lower, package-engaging working surface 32 of the block. In the particular embodiment illustrated, a bore 34 of reduced diameter than the diameter of the recess opening 30 is provided through the remaining thickness of the block of material for engaging reception of a pin member 36 or rivet secured to the confronting pressing surface of the upper jaw member 14*b* of the drawings. This bore and pin arrangement provides one means by which the cushion pressing member may be secured operatively to the working surface of the tool. Alternatively of course the cushion pressing member may be securely mounted by adhesive or other appropriate bonding means as may be desired as indicated by the bonded mounting of cushion member 29 on the movable pressing structure 40 of the ram type tool in FIG. 6 of the drawings.

Figure 2:
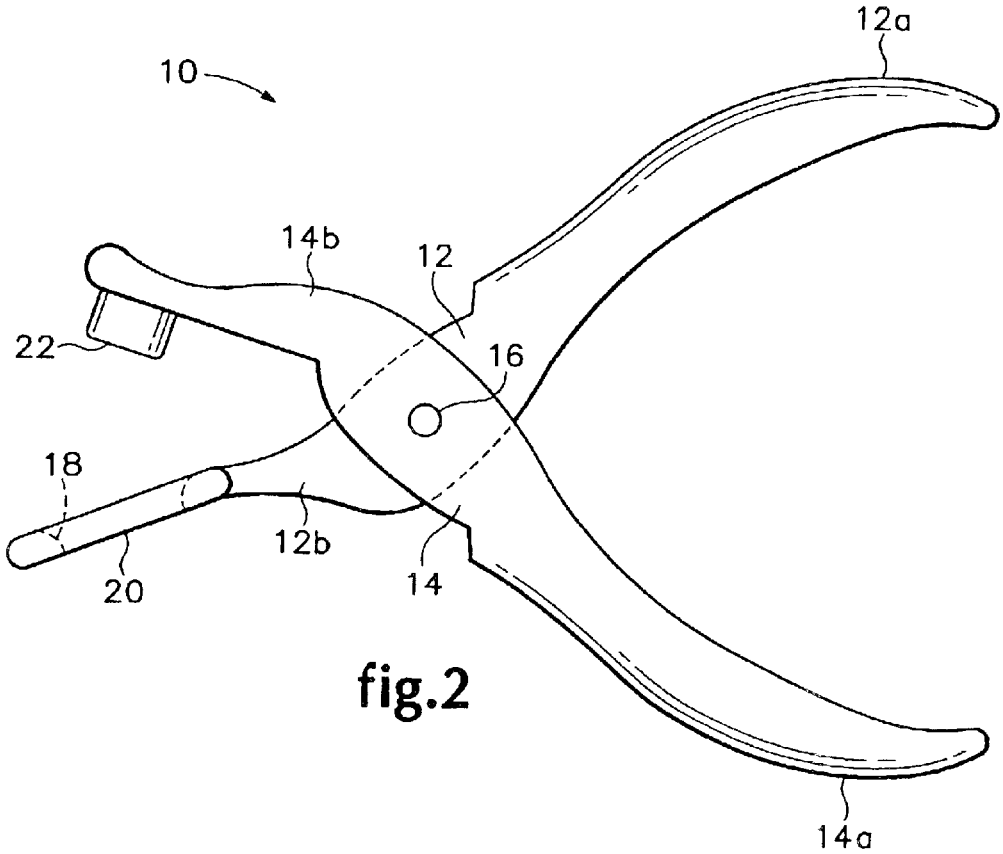
FIG. 2 is a side elevation of a pliers-type blister pack opening tool of the prior art.
Figure 3:
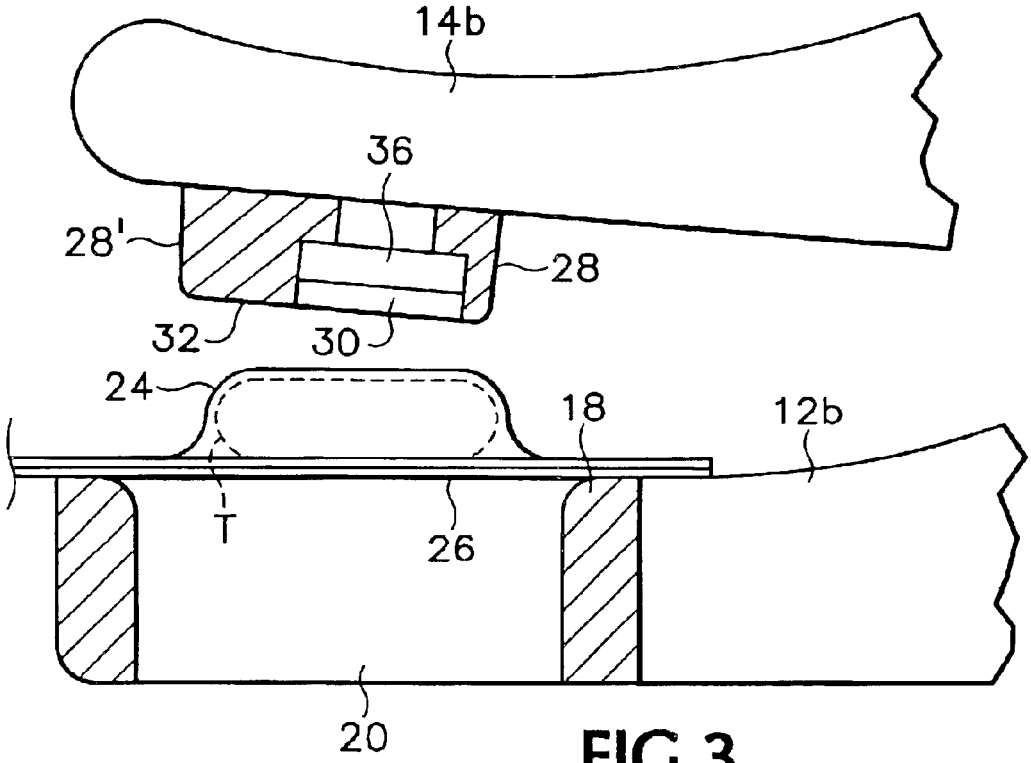
FIG. 3 is a fragmentary sectional view on an enlarged scale of the working portion of the pliers-type tool of FIG. 2 and showing the resilient cushion pressing member of this invention operatively mounted on the confronting end of the pressing jaw member.
Figure 4:
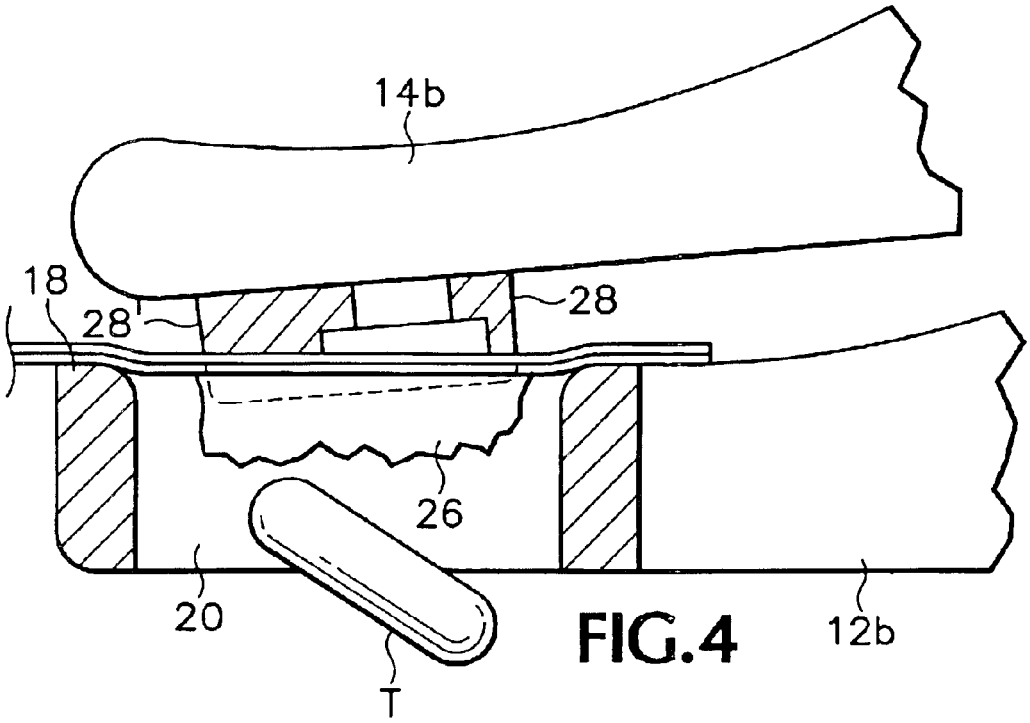
FIG. 4 is a fragmentary sectional view similar to FIG. 3 but showing the approximate position of the resilient cushion pressing member following engagement with and ejection of a tablet-T from a blister package during operation of the tool.

Mounted on the lower, confronting surface of the movable pressing structure 14*b* of the pivotal, pliers-type tool of FIG. 2, it can be seen in viewing FIG. 3 that, in engaging a blister package positioned on the package support base member 12*b*, the lower, confronting surface 32 of the resilient cushion pressing member 28 will initially contact the packaging substantially evenly along its length. As seen in FIG. 4 of the drawings, continued pivoting movement of the pressing structure downwardly about pivot 16 (FIG. 2) effectively moves the forwardly disposed blunted nose portion 28' angularly downward slightly ahead of the rearward portions of the pressing member while still resiliently engaging the top cover of the packaging along the length of the cushion pressing member.

This angular pressing engagement has been found to advantageously assist in the tearing of the bottom cover sheet 26 of the packaging, while the resilient cushioning engagement of the cushion pressing member along the top cover and tablet contained in the blister packaging effectively distributes pressing force and contact evenly over and against the tablet surface as the cushion pressing member deforms somewhat in the pressing operation. It is however the resiliency of the elastomeric material which is essential to the distribution of pressing pressure uniformly over the surface area of the tablet by virtue of the deformation of the elastomeric material which allows it to conform to the confronting surface shape of the tablet beneath the overlying top cover of the packaging.

With these forgoing structural features and aspects of the resilient cushion pressing member of this invention thus described, the operation of a pliers-type hand tool mounting the cushion pressing member provides for the distribution of pressure evenly over the contacted surface area of pills and tablets of virtually all shapes and sizes. Blister packages containing small pills are preferably positioned on the supporting base for engagement by the extended blunted nose portion 28', 29', 29" of the cushion member. Large round or oval pills are positioned for engagement within the recessed opening 30 whereby pressing engagement of the cushion member is distributed evenly over the arcuate surface area of these pills contained beneath the top, blister surface of the blister packaging. Similarly, very soft pills are also extracted by placing them directly beneath the recessed portion for the same purpose. Long tablets and capsules, as seen in FIGS. 3 and 4 of the drawings, are engaged along the entire elongated surface length of the cushion pressing member, thereby distributing pressing contact along the length of the pressing member.

Figure 5:
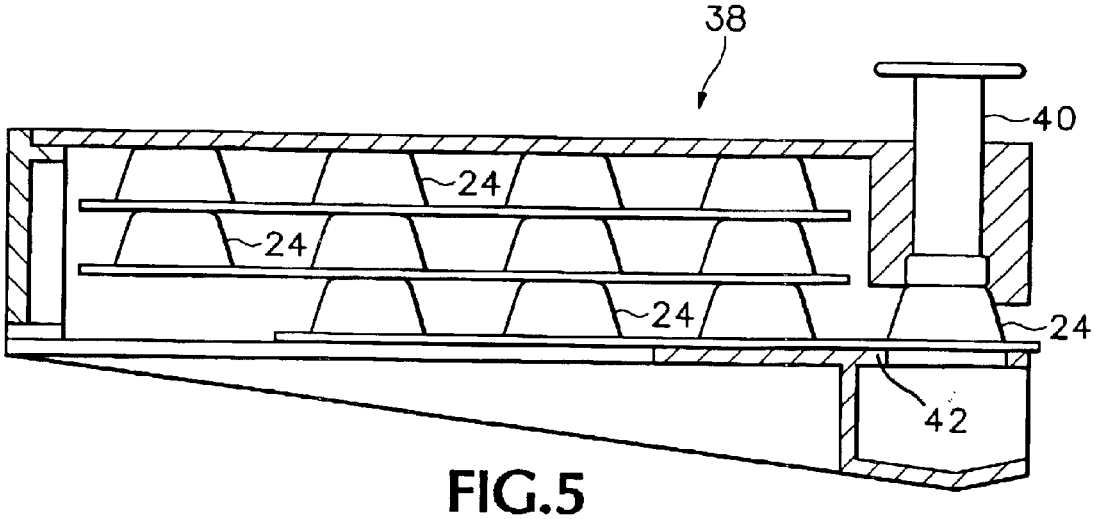
FIG. 5 is a sectional side view through a ram-type pressing tool of the prior art.
Figure 6:
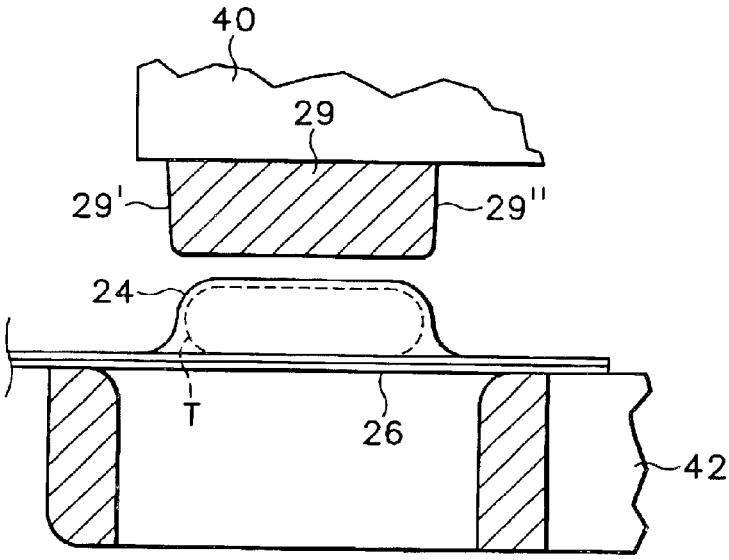
FIG. 6 is a fragmentary sectional view on an enlarged scale of the working portion of the ram tool of FIG. 5 and showing the resilient cushion pressing member FIG. 1A of this invention operatively bonded onto the confronting end of the pressing ram member.

As discussed earlier, the cushion pressing member of this invention may also be used in connection with ram-type tool structures 38 such as shown in FIG. 5 where the moving pressing structure 40 is configured for axial movement substantially directly perpendicularly to the package supporting base 42 of the tool. FIG. 6 illustrates the terminal end of the moving ram member 40 mounting the cushion pressing member 29 of this invention bonded thereto by suitable adhesive means. The function and operation of the resilient cushion pressing member on the axially moving pressing structure of FIGS. 5 and 6 is substantially the same as has been described above in connection with the tool of FIGS. 2, 3 and 4.

Although the cushion pressing member 29 is shown herein as comprising a block of resilient material without an inwardly extending recess in its package-engaging surface, it may if desired include a recess such as 30 in the embodiment of FIG. 1. Similarly, the cushion pressing member 28 of FIG. 1, as well as any other configuration of cushion pressing member, may or may not include a recess as desired or needed for the purpose. Further, although the cushion pressing member may be formed separately and mounted on the movable pressing structure during manufacture of the tool, it can as well be provided as a resilient cushion pressing surface formed substantially integrally with the movable pressing structure as a resilient, package-confronting surface thereof, as may be desirable and advantageous in the manufacture of the tool.

It will be apparent to those skilled in the art that various changes, other than those already described hereinbefore, may be made in the size, shape, type, number and arrangement of the cushion pressing member of this invention without departing from the spirit of this invention and the scope of the pending claims.

Having thus described my invention, I claim:

1. A cushion pressing member for use with tools for removing tablets from blister packages, such tools employing a movable pressing structure arranged to provide pressing engagement upon the top, blister side surface of a tablet-containing blister package supported on a package support base of the tool, the pressing structure movable to press the tablet through the bottom, tear sheet side of the blister package and through an opening provided through the package supporting base of the tool, the cushion pressing member comprising:

a) a cushioning body member configured for mounted support on the movable pressing structure of a tablet removing tool in position thereon for movement therewith into pressing engagement of the cushioning body member with the top blister surface of a tablet containing blister package supported on the package support base of the tool, said cushioning body member formed of an selected elastomeric material having a predetermined resiliency selected to provide resiliently deformable, cushioning interengagement between the movable pressing structure and a tablet-containing blister package during pressing, tablet-removing movement of the pressing structure, and b) mounting means for interengaging said cushioning body member and the movable pressing structure and mounting the cushioning body member on the movable pressing structure in said position thereon for movement therewith into said pressing engagement with the top blister surface of a blister package supported on the package support base of a tool, c) whereby, with the cushioning body member mounted on the movable pressing structure of a tool and with a tablet-containing blister package supported on the package support base of the tool, operation of the movable pressing structure presses the cushioning body member against the top blister surface of the package and in turn presses the tablet against and through the bottom tear sheet of the blister package, the cushioning body member deforming resiliently against the package surface during pressing movement distributing pressing force substantially evenly over the engaged surface of the package and tablet contained therein.

2. The cushion pressing member of claim 1 wherein said cushioning body member is formed of an elastomeric material having a durometer between approximately 60–90.

3. The cushion pressing member of claim 1 wherein said cushioning body member is formed of rubber having a mean hardness of approximately 67.2.

4. The cushion pressing member of claim 1 wherein said cushioning body member is configured with a longitudinally elongated package-engaging surface having at least one tapered longitudinal terminal end portion forming a laterally narrowed blunted nose end at a terminal longitudinal end of said package-engaging surface.

5. The cushion pressing member of claim 4 wherein both opposite longitudinal end portions of said package-engaging surface are tapered to form oppositely extending, narrowed blunted nose ends at opposite longitudinal ends of said package-engaging surface.

6. The cushion pressing member of claim 1 wherein said cushioning body member is configured with a package-engaging surface having an inwardly extending recess configured to receive a portion of an arcuate surface of a rounded tablet contained beneath the top blister surface of a blister package supported on the package support base of a tool.

7. A cushioned pressing tool for removing tablets from blister packages, said blister packages typically having a top blister side and a bottom tear sheet side forming a tablet-containing space therebetween, said cushioned pressing tool comprising:

a) a package support base member for supporting the bottom tear sheet side of a blister package, the package support base member having an opening therethrough said opening being larger than a tablet contained in a blister package supported on the support base, b) a movable pressing structure having a resilient cushion pressing surface for movement into pressing engagement with the top, blister side of a blister package supported on said package support base member for at least partially crushing the top side of the package and pushing the tablet contained in the package through said bottom tear sheet side of the package into said opening provided through said package support base member, and c) means for connecting the package support base member and the movable pressing structure together for movement of the resilient cushion pressing surface into pressing engagement with the top, blister side of a blister package supported on said package support surface, d) said resilient cushion pressing surface formed of an elastomeric material selected to provide a resiliently deformable pressing surface for engaging the top side of a blister package and resiliently deforming thereagainst during pressing operation of the pressing structure and distributing pressing force substantially evenly over the contacting surfaces of the cushion pressing surface and a tablet-containing blister package supported on the package support base member of the tool.

8. The cushioned pressing tool of claim 7 wherein said resilient cushion pressing surface is formed of an elastomeric material having a durometer between approximately 60–90.

9. The cushioned pressing tool of claim 7 wherein said resilient cushion pressing surface comprises a longitudinally elongated package-engaging surface having at least one tapered longitudinal terminal end portion forming a laterally narrowed blunted nose end at a terminal longitudinal end of said package-engaging surface.

10. The cushioned pressing tool of claim 9 wherein both opposite longitudinal end portions of said package-engaging surface are tapered to form oppositely extending, narrowed blunted nose ends at opposite longitudinal ends of said package-engaging surface.

11. The cushioned pressing tool of claim 7 wherein said resilient cushion pressing surface is configured with an inwardly extending recess configured to receive a portion of an arcuate surface of a rounded tablet contained beneath the top blister surface of a blister package supported on the package support base of the tool.

* * * * *